United States Patent [19]

Tornay

[11] 4,204,813

[45] May 27, 1980

[54] LNG PUMP ANTI-SLAM DEVICE

[75] Inventor: Edmund G. Tornay, New York, N.Y.

[73] Assignee: Energy Transportation Group, Incorporated, New York, N.Y.

[21] Appl. No.: 887,086

[22] Filed: Mar. 16, 1978

[51] Int. Cl.[2] ..... F04B 21/00; F04B 39/00

[52] U.S. Cl. ..... 417/435; 62/45

[58] Field of Search ..... 417/53, 435, 471, 279; 62/45, 58

[56] References Cited

U.S. PATENT DOCUMENTS

| | | | |
|---|---|---|---|
| 2,057,624 | 10/1936 | Burkhart | 417/471 |
| 2,348,538 | 5/1944 | Hagen | 417/471 |
| 2,696,785 | 12/1954 | Blue | 417/435 |
| 2,744,469 | 5/1956 | Schaefer | 417/435 |
| 2,808,786 | 10/1957 | Johnston | 417/435 |
| 3,159,006 | 12/1964 | Sliepcovich | 62/45 |
| 3,379,132 | 4/1968 | Wagner | 62/55 |

*Primary Examiner*—William L. Freeh

*Attorney, Agent, or Firm*—William A. Drucker

[57] ABSTRACT

In pumping LNG (liquefied natural gas) from one receiver to another, e.g. from a vessel's tank to a shore installation, it is conventional to use a submerged pump, a riser pipe connecting the pump to a stop valve and flexible joint connecting the stop valve to a header. If a pocket of gaseous LNG is present in the riser pipe, when the pump commences its operation, the advancing column of liquid in the riser pipe slams against the stop valve and may damage it. The invention provides the improvement of a removable or bypassable flow restrictor incorporated between the pump and the riser pipe, permitting to ensure that the riser pipe is completely liquid-filled, before the pump commences to operate.

4 Claims, 2 Drawing Figures

LNG PUMP ANTI-SLAM DEVICE

BACKGROUND OF THE INVENTION

In the conventional systems for pumping of liquefied natural gas (LNG) from one receiver to another, for instance from the tank of a sea-going vessel to a header pipe leading to a shore installation, it is conventional to use a pump which is submerged in the LNG in the vessel's tank. A riser pipe connects the outlet of the pump to a stop valve outside the usual dome of the vessel's tank, and a flexible connection connects the stop valve to a header leading to the shore installation.

With the systems as at present used, there is a possibility that a pocket of LNG in gaseous state becomes formed in the riser pipe between the outlet of the pump and the inlet of the stop valve. When the pump is subsequently operated, the column of liquid advances up the riser pipe and, due to the pressures involved, causes collapse and liquefaction of the gas in the pocket. The column of liquid accordingly slams against the stop valve and can damage the valve or piping.

OBJECT OF THE INVENTION

It is accordingly the object of the invention to provide an improved apparatus, and a method for operating such apparatus which avoids the slamming of the liquid column against the stop valve.

SUMMARY OF THE INVENTION

According to the invention, in apparatus for pumping liquefied gas from a container to a receptacle, of the kind including a pump having an inlet and an outlet and with its inlet communicating with the interior of the container, a riser pipe having a first end communicating with the outlet of the pump, and an openable and closable stop valve interposed between a second end of the riser pipe and the receptacle, there is provided the improvement which comprises flow restrictor means, interposed between said first end of the riser pipe and the outlet of the pump, having a first condition of operation in which flow between the riser pipe and the pump is restricted, and a second condition of operation in which flow between the riser pipe and the pump is unrestricted.

The flow restrictor means may comprise a check valve including a movable closure element, said closure element having aperturing to permit restricted flow, or in combination, a check valve and a flow restrictor connected in parallel to bypass said check valve.

Further according to the invention, a method of operating the apparatus comprises the steps of:

(i) with said flow restrictor in restricting condition, opening said stop valve and permitting flow of liquid into the riser pipe until the riser pipe is filled, (ii) starting the pump, opening the stop valve, and placing the flow restrictor in unrestricting condition, in any order.

Two embodiments of apparatus in accordance with the invention are hereinafter particularly described with reference to the accompanying drawing.

DESCRIPTION OF THE PREFERRED EMBODIMENT

Figures 1, 2:
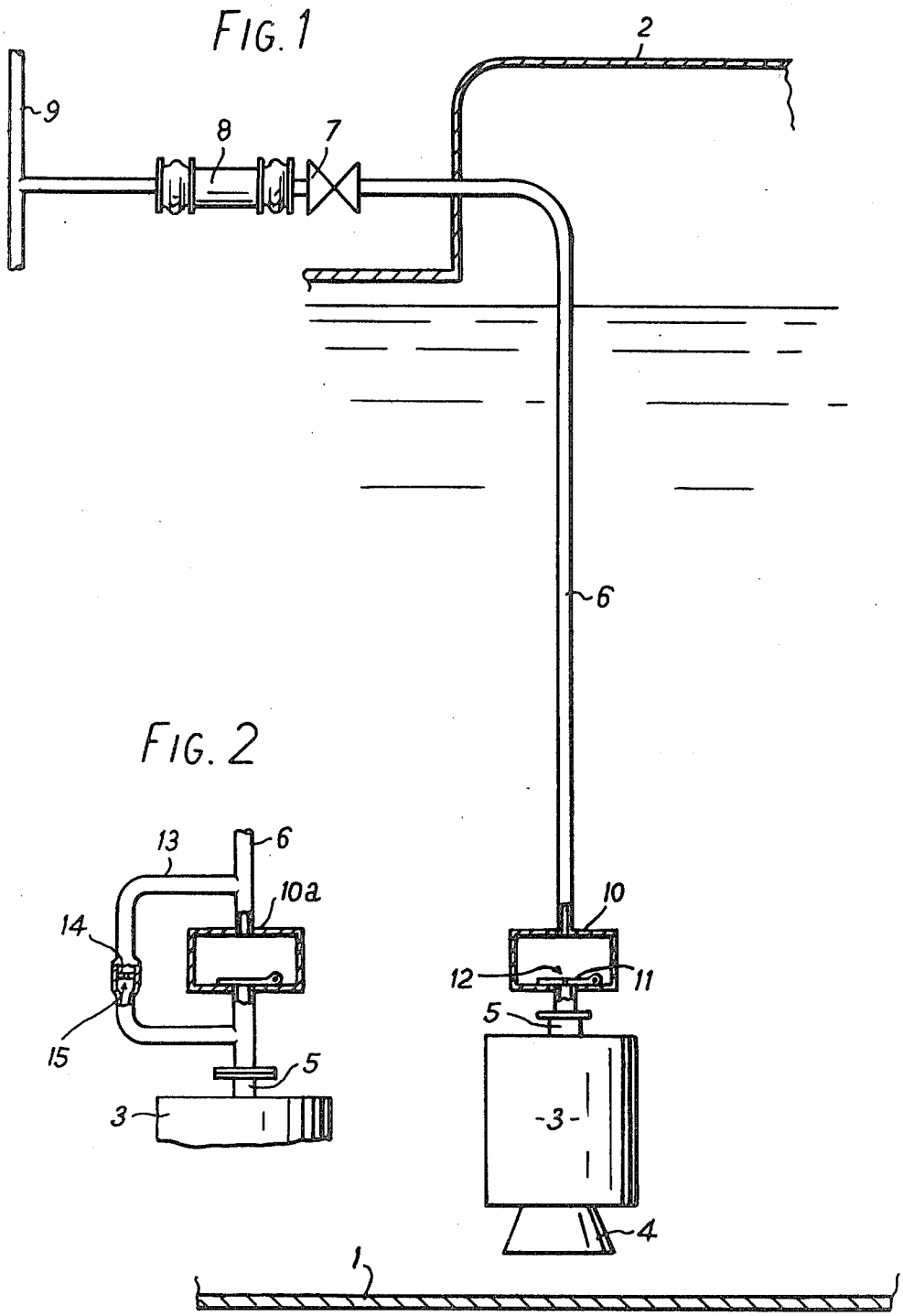
FIG. 1 is a schematic elevation in which certain portions are shown in elevation, and a first embodiment of check valve flow restrictor is shown in section.
FIG. 2 is a section of a second embodiment having a check valve and a by-pass flow restrictor, the remainder being identical to that of FIG. 1.

Referring to the accompanying drawing, a tank for LNG (liquefied natural gas) in a tanker vessel is bounded by a base 1, a conventional dome 2, and a side wall (not shown). It is conventional, for the pumping of LNG from such a tank, to utilise a pump 3 having an intake 4 and an outlet 5. These pumps, as currently used, are radial centrifugal pumps which accordingly permit substantially free flow of fluid through them when the pump is not operational.

It has hitherto been conventional to connect the outlet 5 of the pump 3 directly to a riser pipe 6 leading to a stop valve 7, and thence through a flexible connection 8 to a header pipe 9 situated on the vessel and connected to installation on the dockside. In such an arrangement there may occur a residual pocket of LNG in its gaseous state in the riser pipe 6 between the outlet 5 of the pump 3 and the inlet side of the stop valve 7. When the pump is started the LNG in liquid state is driven up the riser pipe 6 and causes collapse of the gas pocket, so that the leading end of the advancing column of liquid slams into the inlet side of the stop valve 7 and can seriously damage the valve, because there is a considerable mass of liquid moving rapidly and providing almost a "solid" connection between the rotor of the pump and the leading end of the liquid column, the whole having considerable inertial kinetic energy.

In accordance with the invention, a removable or bypassable liquid flow restrictor is incorporated in the system between the lower end of the riser pipe 6 and the outlet 5 of the pump 3. This flow restrictor is constructed to have a first condition of operation in which it restricts flow of liquid LNG in the direction from the riser pipe 6 to the pump 3, and a second condition of operation in which it allows unrestricted flow of liquid LNG in the direction from the pump 3 to the riser pipe 6.

In the first embodiment shown in FIG. 1, the restrictor is shown by way of very much simplified illustration, as comprising a simple shutter valve 10 in which the shutter 11 has in it a small hole 12. When the shutter is in the closed position as illustrated, liquid can nevertheless flow at a relatively very slow rate down the riser pipe 6 and into the pump 3. When the shutter is moved, to the right in this figure, to remove it clear of the end of the pipe to the pump, the output flow from the pump is unrestricted.

FIG. 2 shows a second embodiment wherein the shutter valve **10*a* does not have a hole in its shutter, but there is provided instead a bypass pipe 13 in which there is a flow restrictor 14 having therein a small hole 15. When the shutter valve 10 is in the closed condition, the bypass pipe 13 and flow restrictor 14 permit a small flow of liquid from the riser pipe 6 down into the pump 3. When the shutter valve 10*a* is in open condition, the flow from the pump 3 to the riser pipe 6** is unrestricted.

With the improved arrangement of the invention, the sequence of operations, for commencement of pumping from the vessel's tank to the header 9, is as follows:

With the check valve closed, the stop valve 7 is opened, and liquid LNG is allowed to flow from the header 9 into the riser pipe 6 to fill the pipe. Liquid cannot drain rapidly into the vessel's tank, because of the presence of the check valve 10, or 10*a*, in closed condition. Nevertheless, the hole 12 or 15 permits a very slow rate of flow until the riser pipe 6 is completely filled with liquid rather than gas. If any gaseous LNG is initially present in the system it is either condensed by the pressure of the inflowing supply from the header 9, or escapes upwardly into the header 9. Thus, the whole of the system, between the outlet end of the pump 3, and the header 9, is completely filled with liquid LNG, without any pocket of gas present, Accordingly, when the pump 3 is started, there is no pocket of gas situated at the upstream end of the liquid column, and accordingly there is no action of slamming of the leading end of a liquid column up against the inlet of the valve 7.

The hole 12 or 15 also serves a secondary purpose in that, if the stop valve 7 is closed, and a (non-bypassed) check valve, adjacent the pump outlet, is also closed, there could be a build up of pressure in the riser pipe 6 due to evaporation of liquid LNG in that pipe. Such build up of pressure is avoided by the bleeding away of liquid and/or gas through the hole 12 or the hole 15.

It will be appreciated by those skilled in the art that the dimensions of the hole 12 or 15 must be small enough to permit proper priming of the riser pipe 6, but large enough to relieve any pressure build up.

I claim:

1. In an apparatus for pumping liquefied gas from a container to a receptacle, of the kind including a pump having an inlet and an outlet and with its inlet communicating with the interior of the container, a riser pipe having its lower end communicating with the outlet of the pump, and an openable and closable stop valve interposed between the upper end of the riser pipe and the receptacle, the improvement which comprises flow restrictor means interposed between said lower end of the riser pipe and the outlet of the pump, said flow restrictor means having a first condition of operation in which reverse flow from the riser pipe to the pump is permitted in restricted manner, said flow restrictor means having a second condition of operation in which flow from the pump to the riser pipe is permitted in unrestricted manner.

2. Apparatus, as claimed in claim 1, wherein said flow restrictor means comprises a check valve including a movable closure element movable to an open position to permit unrestricted flow from the pump to the riser pipe, said closure element having aperturing to permit restricted reverse flow.

3. Apparatus, as claimed in claim 1, wherein said flow restrictor means comprises, in combination, a check valve including a movable closure element movable to open position to allow unrestricted flow from the pump to the riser pipe, and a flow restrictor connected in parallel to bypass said check valve.

4. The method of operating the apparatus of claim 1 which comprises the steps of:

(i) with said flow restrictor means in said first condition, opening said stop valve and permitting reverse flow of liquid from said receptacle into the riser pipe, with passage of vapour from the riser pipe through the pump in reverse flow, until the riser pipe is filled with liquid from the receptacle, (ii) thereafter starting the pump, and placing the flow restrictor means in its second condition, in either order.

* * * * *